US010085570B2

(12) United States Patent
Bellam et al.

(10) Patent No.: US 10,085,570 B2
(45) Date of Patent: Oct. 2, 2018

(54) POSTURE DETECTION AND CORRECTION CUSHION

(71) Applicants: Srigiri Shankar Bellam, Richmond, TX (US); Rhushabh Bhandari, Richmond, TX (US)

(72) Inventors: Srigiri Shankar Bellam, Richmond, TX (US); Rhushabh Bhandari, Richmond, TX (US)

( * ) Notice: Subject to any disclaimer, the term of this patent is extended or adjusted under 35 U.S.C. 154(b) by 166 days.

(21) Appl. No.: 15/153,828

(22) Filed: May 13, 2016

(65) Prior Publication Data

US 2017/0325599 A1 Nov. 16, 2017

(51) Int. Cl.

| | |
|---|---|
| ***A47C 31/12*** | (2006.01) |
| ***A47C 7/46*** | (2006.01) |
| ***A47C 7/62*** | (2006.01) |
| ***A47C 7/14*** | (2006.01) |

(52) U.S. Cl.

CPC ..... *A47C 31/126* (2013.01); *A47C 7/14* (2013.01); *A47C 7/467* (2013.01); *A47C 7/62* (2013.01)

(58) Field of Classification Search

None

See application file for complete search history.

(56) References Cited

U.S. PATENT DOCUMENTS

| | | | | |
|---|---|---|---|---|
| 4,097,087 | A * | 6/1978 | Garavaglia | A47C 7/46 297/230.14 |
| 4,655,505 | A * | 4/1987 | Kashiwamura | A47C 7/467 297/284.6 |
| 4,944,554 | A * | 7/1990 | Gross | A47C 7/462 297/284.3 |
| 5,170,364 | A * | 12/1992 | Gross | A47C 4/54 702/139 |
| 5,625,914 | A * | 5/1997 | Schwab | A47C 21/006 297/284.1 |
| 6,203,105 | B1 * | 3/2001 | Rhodes, Jr. | A47C 4/54 297/284.6 |
| 6,334,837 | B1 * | 1/2002 | Hein | A47C 15/004 482/8 |
| 6,384,715 | B1 * | 5/2002 | Potter | A47C 7/467 340/407.1 |
| 7,540,564 | B2 * | 6/2009 | Gokhale | A47C 7/425 297/230.14 |
| 9,710,788 | B2 * | 7/2017 | Horseman | G06F 19/3418 |
| 9,795,322 | B1 * | 10/2017 | Karunaratne | A61B 5/1116 |
| 2006/0238006 | A1 * | 10/2006 | Baranov | A47C 1/03 297/284.3 |

(Continued)

FOREIGN PATENT DOCUMENTS

| | | | | |
|---|---|---|---|---|
| EP | 2957193 | A1 * | 12/2015 | A47C 1/00 |
| WO | WO-2009089647 | A1 * | 7/2009 | A47C 31/126 |

*Primary Examiner* — David E Allred

(74) *Attorney, Agent, or Firm* — South Texas College of Law—Houston

(57) ABSTRACT

A method of detecting and correcting a user's posture through use of a mobile posture-detection cushion for a chair or any other seating apparatus. The cushion contains individual support modules that actively monitor a user's current seated position and adjust the user to attain an optimum sitting posture in response to individual pressure sensors within the cushion, and provides user-specific feedback to each individual user over a period of time of use of the cushion.

9 Claims, 6 Drawing Sheets

(56) References Cited

U.S. PATENT DOCUMENTS

| | | | | |
|---|---|---|---|---|
| 2008/0211277 | A1* | 9/2008 | Goetz | A47C 7/46 297/230.14 |
| 2010/0276973 | A1* | 11/2010 | Zenk | B60N 2/914 297/284.3 |
| 2013/0278029 | A1* | 10/2013 | Davis | A47C 7/467 297/230.1 |
| 2013/0341980 | A1* | 12/2013 | Halliday | A47C 31/126 297/284.3 |
| 2014/0167463 | A1* | 6/2014 | Sakata | B60N 2/914 297/284.3 |
| 2015/0008710 | A1* | 1/2015 | Young | B60N 2/914 297/217.3 |
| 2015/0038881 | A1* | 2/2015 | Gokhale | A61B 5/1116 600/595 |
| 2015/0321590 | A1* | 11/2015 | Mizoi | B60N 2/62 297/284.1 |
| 2016/0183687 | A1* | 6/2016 | Hoyt | A47C 31/126 297/217.2 |
| 2017/0197523 | A1* | 7/2017 | Magana | B60N 2/90 |

* cited by examiner

POSTURE DETECTION AND CORRECTION CUSHION

BACKGROUND OF THE INVENTION

This invention concerns a device for detecting and correcting a user's posture. According to the National Institute of Occupational Safety and Health, over fifty percent (50%) of the United States workforce suffers from repetitive stress injuries, particularly back injuries (acute, chronic, and repetitive) caused by sitting for long hours at work carrying out a variety of functions.

Individuals are often unaware of their optimal posture, and routinely settle into injurious and damaging sitting positions. The poor posture further leads to the individual slumping or inclining forward towards a desk or objects on a workbench.

The practice of extended improper sitting posture could negatively impact a person's body. Damage may include but not be limited to; organ damage, muscle degeneration, leg disorders, and extremity pains. In an effort to reduce the bodily injuries and discomforts realized from incorrect sitting posture, conventional ergonomic chair devices were created to address and alleviate the negative effects improper sitting positions have by attempting to passively support an individual's back region.

However, significant drawbacks with the conventional back supporting products are that they are static in nature or can only be manually manipulated by the user. While many of these ergonomic products have lessened the instances of bodily injury, the standard products lack adaptability and/or mobility, user interface, self-correcting capabilities, and an overall long-term feedback scheme that would interactively and continuously correct and train the user to utilize proper posture position when sitting.

In addition, many of the back supporting products are pre-molded to align with the curvature of a user's lower spine, and do little to achieve long-term optimum sitting position for the user. Further, the products fail to address the neck, upper back, and pelvic region of the back, and focus primarily on the central portions of the user's back, which can cause the spine to misalign and exacerbate neck and back injuries.

A key consideration when analyzing and correcting posture is that sitting positions are unique to each individual, and a 'one size fits all' approach to correcting a user's posture is not idyllic. Additionally, an individual's posture may be affected by their current mood, tiredness, and overall physical condition. As such, there is a current need for a device that takes into account an individual's current distinctive sitting position when attempting to alleviate bodily injuries.

BRIEF DESCRIPTION OF THE DRAWINGS

FIG. 2(*b*) illustrates a perspective view of a chair equipped with the posture detection cushion as an integrated system in accordance with an exemplary embodiment of the invention.

FIG. 3(*b*) illustrates the front view of the pneumatic individual module system, including an illustration of the individual pressure modules and the pneumatic actuator valves in accordance with an exemplary embodiment of the invention.

FIG. 3(*c*) illustrates a back view of the pneumatic individual module system, including illustration of the support valves and an exemplary heating and cooling feed/return scheme in accordance with an embodiment of the invention.

FIG. 3(*d*) illustrates the individual pressure sensors within the individual pressure modules in accordance with an exemplary embodiment of the invention.

FIG. 4(*b*) illustrates a front view of the mechanical individual module system in accordance with an exemplary embodiment of the invention.

FIG. 4(*c*) illustrates a partial back view of the mechanical individual pressure module in accordance with an exemplary embodiment of the invention.

DETAILED DESCRIPTION OF THE PREFERRED EMBODIMENTS

Figure 1:
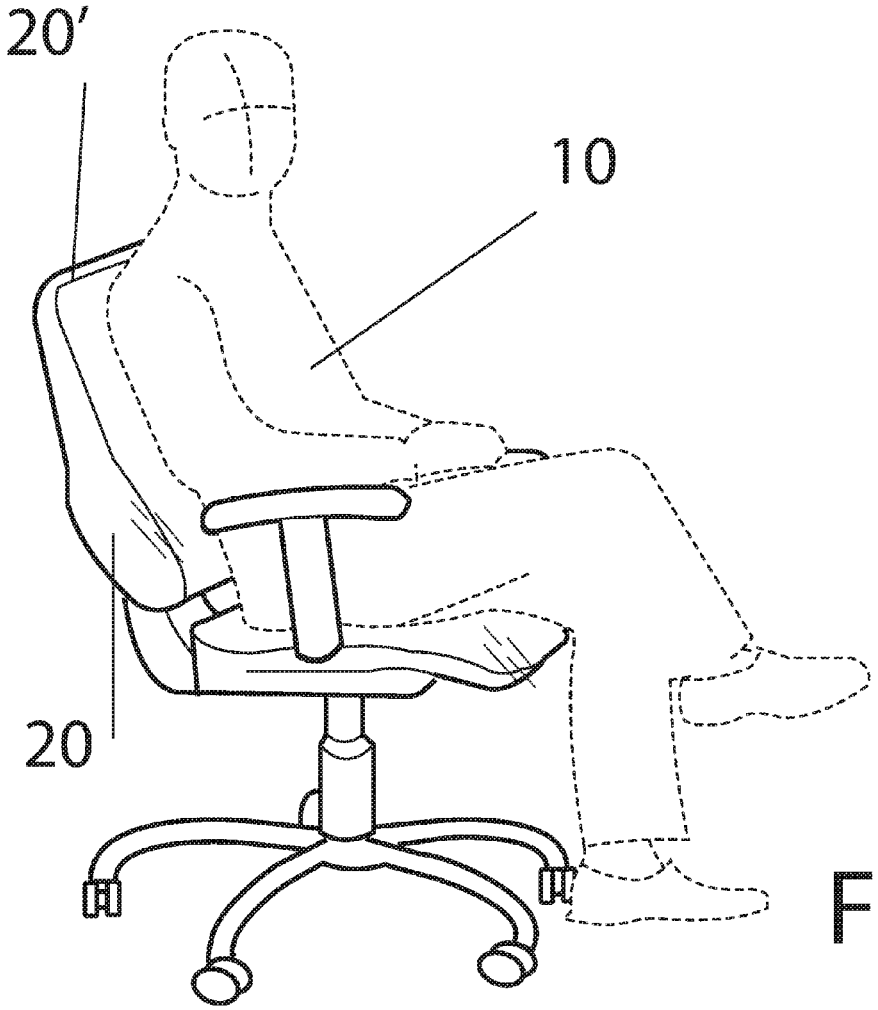
FIG. 1 illustrates a view of a user seated in chair that is equipped with the posture detection cushion in accordance with an exemplary embodiment of the invention.

Our invention actively adjusts, corrects, and subliminally trams the user to maintain their unique ergonomic sitting posture. By providing user-specific feedback to the individual over a period of time, the individual is prepared to assume their ergonomic sitting position and will be able to sit in a chair with ergonomic posture without the assistance of the innovation described herein. The individual has the freedom to adjust manually using a software application or remote control to suit his or her preference.

The present invention provides an intelligent posture-detecting ergonomic cushion that attaches to a chair, which reinforces a user's proper sitting posture. The posture-detecting cushion includes a plurality of sensors used to provide a detailed sensory feedback in real time through a corresponding application with which the sensor device communicates.

According to an exemplary embodiment, the posture-detecting cushion can be outfitted to accommodate chairs with varying sizes, dimensions, and shapes. This implementation may include one or more detachable straps, belts, or other fixation apparatuses that can be used to attach or fasten the posture-detection cushion securely to an existing chair's back. In another implementation, the posture-detection cushion may be embedded into a chair or other sitting location (e.g. a vehicular seat).

The straps may be formed by an elastic material that may stretch to conform to any chair's shape, size, and dimension outfitted with the posture detection cushion. Each strap attachment may be on one side of the cushion, while the other end of the strap is connected via buckles, latches, or fasteners. Alternatively, the straps are adjustable in length to fit a variety of chairs.

The posture-detecting cushion can be formed of any suitable material or a combination of materials such as, but not limited to, fabric, foam, leather, plastic, or polystyrene, in addition to the active components of the cushion. The present posture-detecting cushion can be formed as a two-part portion with a back support portion and a seat portion, connected by a fold in the chair pad material. Alternatively, the back support portion and the seat portion can be fashioned as a separate pad, connected to one another, or a segment that operates with each other according to the present invention, such that their relative positions are joined so that an accurate interpretation of the posture or sitting position can be determined. The support portions are comprised of a semi-ridged back and a flexible cushion front, with a plurality of pressure modules disposed there between.

In the previous approach, the device may be medically adaptive in which it can be utilized in the preferred upright sitting, or can be placed in a reclining position, or lying position as in on a bed. The inner surface of the front side of the posture-detecting cushion that contacts the user's back region is formed to be of a curved and generally convex nature, in order to align properly with the natural curvature of the user's spine and shoulder/lower back region. The inner surface of the cushion may also be of a complex curvature shape to adapt to the spinal curvature of the user.

Within the preferred embodiment, the posture-detecting cushion includes a sensor module or plurality of sensor modules distributed throughout the cushion in a manner that accurately measures zones of interest of the user's back position, including, but not limited to the lumbar, pelvic, mid, and upper back regions. In the embodiment discussed below, the sensor module's purpose is to detect the events or changes in its surrounding environment, and to provide a corresponding output.

The pressure modules may include, but are not limited to, electronic, magnetic, electromechanical, and pneumatic systems. Sensors that are connected to a graphical user interface may be configured to show the posture-detecting cushion's activation, the contact or presence of the user when the sensor is in the neutral position, or the amount of pressure that is present on each sensor. Sensors may include haptic sensors or flex sensors to measure pressure or create a pressure map.

A measurement zone is one or more pressure modules related to a particularized body zone. The measurement zones are charted and the system calculates, interprets, and produces a visual output. It then adjusts the individual support modules to urge the user into a more optimal position. The procedure is referred to as the adjustment cycle(s). Each sensor location corresponds to a pressure-map zone, and a human body image is displayed on an application on the embedded user interface, cellular phone, or other computing device.

As the user changes their posture or redistributes their body weight, the information from each sensor is monitored by the microprocessor and is translated to the graphical interface illustration, which will then be available for the user to access on their chosen device. The user interlace can be programmed to alert the user when they have shifted from the suggested optimal posture or have assumed an incorrect posture. The alert can be done in either real time or at intermittent intervals.

The alert may be accomplished through various channels, including, but not limited to, an audible tone projected through a connected personal computer, or a visual warning on a user interface, or a warning signal such as the actuation of a vibrator embedded into the cushion. In another embodiment, the pressure sensors are arranged within zones and are categorized based on the specific region of the human torso; the $1^{st}$ zone corresponding with upper neck, the $2^{nd}$ zone corresponding to the mid region, the $3^{rd}$ zone corresponding to the lumbar region, and the zone corresponding with the pelvic region of the human back. In other embodiments, the zones may be further divided into left and right halves for more precise positional monitoring and adjustments. Additional sensors can be located throughout the posture-detection cushion to improve sensing capability of the cushion and increase the data that is collected.

The preferred embodiment includes individual support modules or bolster pads that actively adjust by protracting or retracting a padded region (pad) with an embedded pressure sensor against the user's body through the cushion's surface. The protraction or retraction of the pad increases or decreases the pressure against the user's body and is monitored by the pressure sensor. Each individual module supplies a varying degree of force to a particularized region of the user's body based on the sensory feedback retained from the user interface/microprocessor system, and the calculated optimal posture position.

The individual module is a self-contained unit or item which interacts with the controller to determine and adjust the user's posture by cooperating between a plurality of modules. The present embodiment comprises a mechanical support module that includes, but is not limited to a magnetic, electromechanical, or pneumatic system for active movement of the support plate. Each embodiment, comprises a pressure pad internal and positioned adjacent, to the inside of the cushion's front panel. The pressure module has a pressure sensor to sense the force the user exerts against the cushion. The pressure module further comprises a pad actuator which protracts or retracts to move the pressure pad and thus vary the force exerted back against the user through the pressure pad. In alternative embodiments, the pressure sensor may be incorporated into the pad actuator as a feedback sensor. By sensing the force a user exerts against the cushion in a particular region of the cushion, and coordinating the protraction and retraction of the pad actuators, the cushion can adjust a user's position by adjusting the force the cushion exerts back against the user.

In an electromagnetic embodiment of the invention, the individualized module may contain a permanent magnet on the back side of a padded cushion and a corresponding electromagnetic coil attached to the support backing. Adjusting the electrical current in the electromagnetic coil varies the magnetic resistance to the permanent magnet and the pressure exerted against the user. The back-pressure the user exerts against the cushion pad can be detected as electrical resistance using the pressure sensor on the surface of the padding, or by sensing the electrical feedback resistance of the coil.

In a mechanical embodiment of the invention, the individualized support modules may contain a pressure sensor on a cushion pad and a threaded rod from the back of the cushion pad to a receiving thread in a motor attached to the support backing. The motor can be adjusted to retract or extend the threaded rod increasing or decreasing the distance of the cushion pad from the support backing, and the pressure the cushion pad exerts against the user. The pressure the user exerts back against the cushion pad can be detected through the pressure sensor.

In another embodiment, the individual support modules could be comprised of a plurality of airbags. The modules would utilize one or more small air compressors that connect to the air bag(s) through a series of values inside the cushion that would inflate each airbag. This may be achieved by a mechanical switch that opens and closes the air passageways so the modules inflate a series of designated airbags in response to the feedback from the sensors.

In order to regulate the intensity of the impact to the user's posture, the sensors will connect with a microprocessor that instructs the individual support modules on when and how to activate the airbags. In another embodiment, the posture-detecting cushion could contain liquid or gel support modules. This would be achieved by including a waterproof membrane similar to those found in a waterbed, coupled with a series of valves to accommodate the change in pressure as the liquid or gel flows in and out of the membrane.

Valves at one end of the membrane chamber allow the module portion of the cushion to be filled, coupled by tubes to an electric pump. The pump recirculates the liquid or gel inside the cushion, pushing it through the valves within a module, creating an exertion of force through the cushion, which in turn actively allows the adjustment of the user's posture.

To increase the area impact on the user, the valve will include a rotor inside the module. Any of the above-mentioned embodiments may include a heating and cooling system to enhance the ergonomic features of the posture-detecting cushion. In another implementation the cushion has vibrating mechanisms that would provide massaging to the user for relief to the back from extended sitting hours.

In another implementation, the pressure map, body image, and sensory feedback are automatically or semi-automatically aligned based on the user's previous posture history, which enables the user to establish unique user identification information that the device recognizes. For example, a user profile can be created that identifies the user by name or some other identification technique. This identification can be based on, but not limited to, height, weight, prior sitting habits, or manual user input. This identification can also be done automatically using sensors. Other embodiments may include haptic or flex sensors to create a pressure map, or sensors to measure bio-signals or activity signals including gyrometers, accelerometers, and biosensors.

Preferably, this user will utilize the posture-detecting cushion on multiple occasions, and the information recorded during each use can be separately recorded, saved, and used to analyze whether a user's posture is improving over a period of time. The invention can be used to train the user to adopt and maintain proper posture based on the sensory data and user profile system, which automatically aligns the individual's user data with the profile.

This allows for a reduction in the initial set up by the operator. In another embodiment, posture adjustment settings can be selected by the user, which will enable the user to override the sensory feedback system of the user interface in favor of the user's individual preferences. In a further embodiment, the posture-detection cushion may be configured to be operable with a personal computer, mobile device, or physical control and display. The operable connection can be accomplished either by wire connection such as a USB cable, or by wireless connection like Bluetooth connection.

The software application that is integrated into the user interface of the posture-detecting cushion is outside the scope of this present invention, however the personal computer is programmed with the software to recognize the connection to the microprocessor and to provide a graphical user interface, which can be viewed by or receive inputs or commands from the user while the posture detection cushion is in place.

DETAILED DESCRIPTION OF THE DRAWINGS

FIG. 1 illustrates a view of a user seated in chair that is equipped with the posture detection cushion in accordance with an exemplary embodiment of the invention. The user (10) is shown in a typical office chair (20) which has a chair back (20') with an integrated pressure sensing cushion.

Figure 2A:
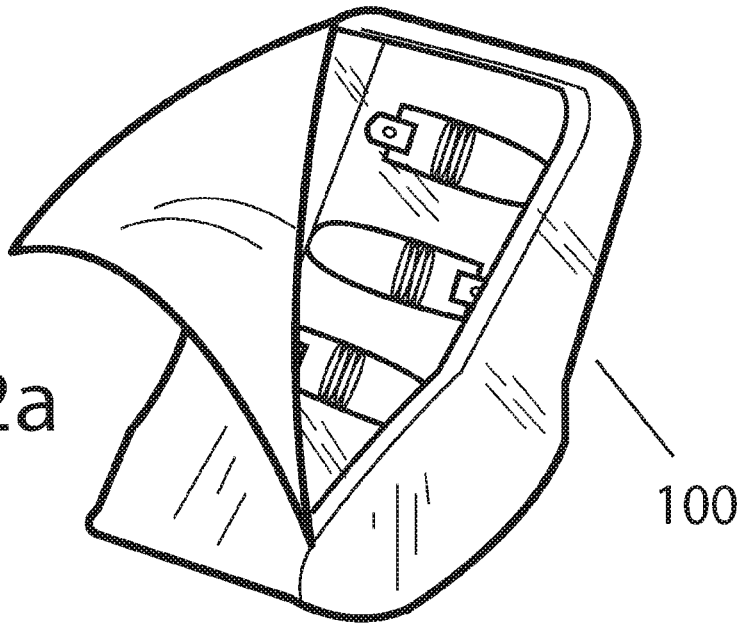
FIG. 2(*a*) illustrates a front view of the cushion with its material slightly removed to display the inside, including a view of the individual pressure modules and the pneumatic actuator valves in accordance with an exemplar embodiment of the invention.
Figure 2B:
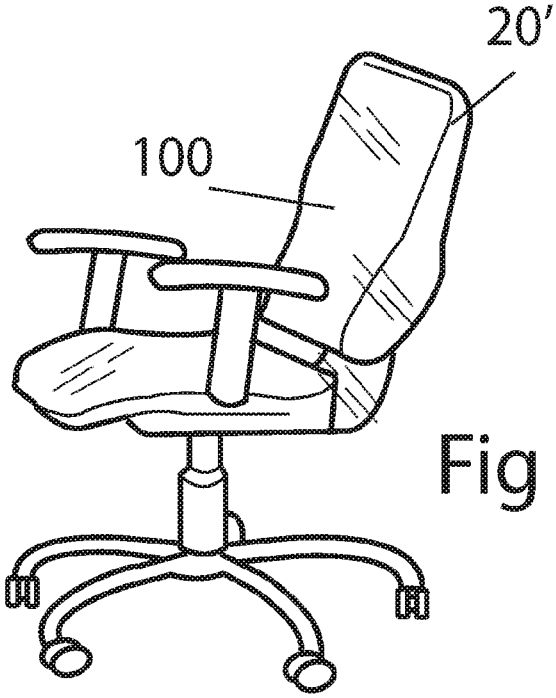
Figure 3B:
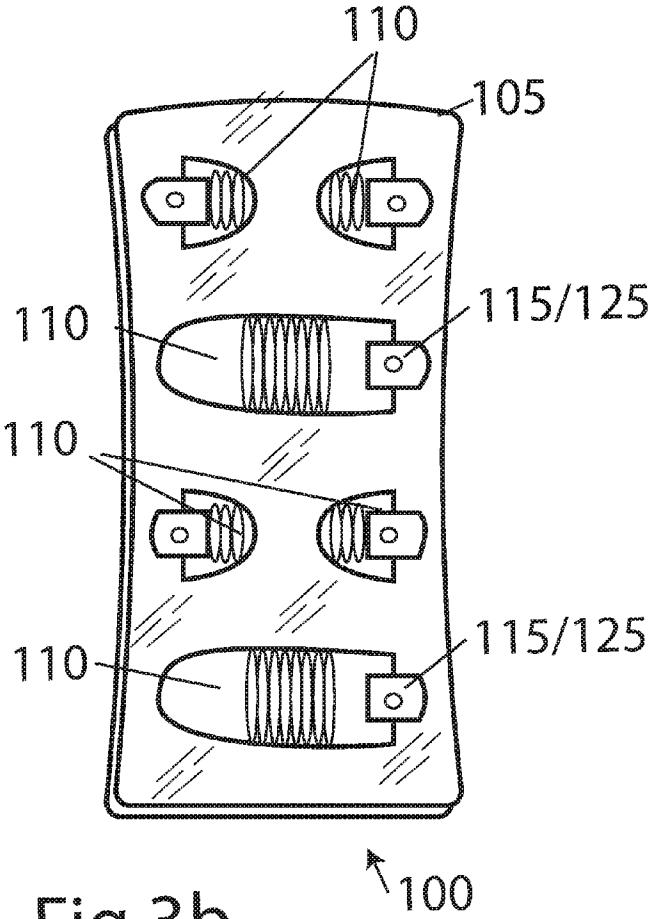
FIG. 3(*a*) illustrates a cross-sectional view of the pneumatic individual module system in accordance with an exemplary embodiment of the invention.
Figure 3A:
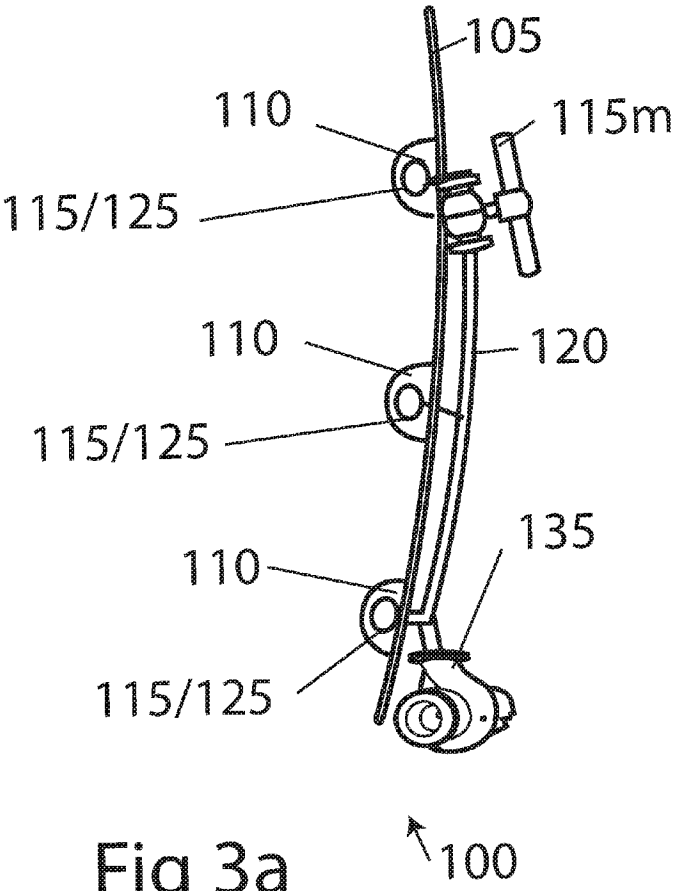
Figure 3D:
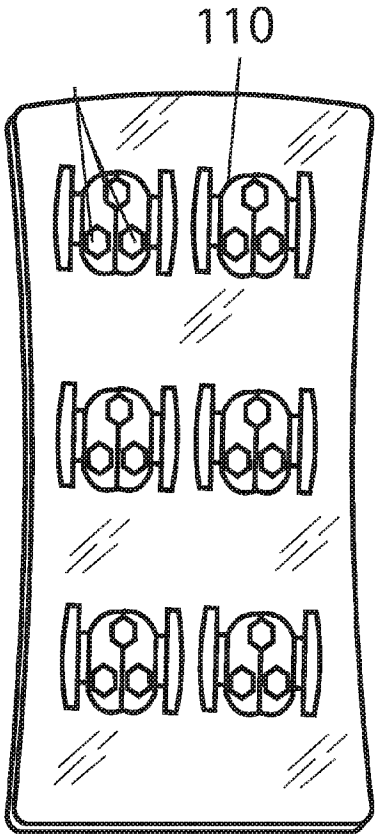
Figure 3C:
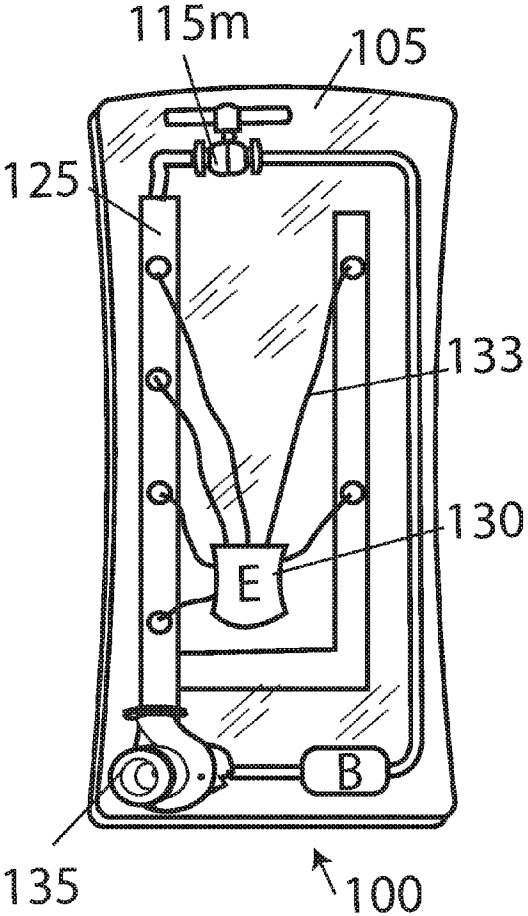

FIG. 2(*a*) illustrates a front view of a cushion (100) with its material slightly removed to display the inside, including a view of the individual pressure modules and the pneumatic actuator valves in accordance with an exemplary embodiment of the invention. This cushion (100) is independent and may be utilized in an office chair, a vehicular chair, or other location where a user may spend extended time sitting.

FIG. 2(*b*) illustrates a perspective view of a chair equipped with the posture detection cushion as an integrated system in accordance with an exemplary embodiment of the invention. The Chair (20) has a cushion (100) installed as a part of the chair back (20').

FIG. 3(*a*) illustrates a cross-sectional view of the pneumatic individual module system in accordance with an exemplary embodiment of the invention. The cushion (100) contains a support backboard (105) which positions the individual pressure modules (110) at the desired sensing zones for the user along the front of the backboard (105). Each individual pressure module (110) comprises a pressure sensor that determines the pressure of the user against the zoned area and a control valve (125) for allowing air into or out of the specific pressure module (110). The plurality of individual pressure sensors is connected (120) together so that a single blower (135) can be used to individually inflate each of the pressure modules (110). The shared connection (120) also allows a single master vent (115*m*).

FIG. 3(*b*) illustrates the front view of the pneumatic individual module system, including an illustration of the individual pressure modules and the pneumatic actuator valves in accordance with an exemplary embodiment of the invention. The cushion (100) is illustrated with a plurality of pneumatically inflatable pressure bags (110) arranged on the backboard (105) to correspond with desired zones of the individual's back. The pressure is sensed by the pressure sensors (115) located in each inflatable pressure bag (110) and the valve (125) allows air to be vented to and from the pressure bag (110) as necessary to achieve the desired support.

FIG. 3(*c*) illustrates a back view of the pneumatic individual module system, including an illustration of the support valves and an exemplary heating and cooling feed/return scheme in accordance with an embodiment of the invention. The plurality of pressure bas (110, shown in previous drawing) are connected together (125) such that a single pump (135) may route air/water/liquid into and out of each individual pressure module (110, previous drawing). The electronic controls (130) are wired (133) to each control valve (125, previous drawing) to allow cycling through a reservoir (B) which can incorporate heating and cooling capabilities. FIG. 3(*d*) shows an alternative arrangement for individual pressure sensors (110) in accordance with an exemplary embodiment of the invention.

Figure 4B:
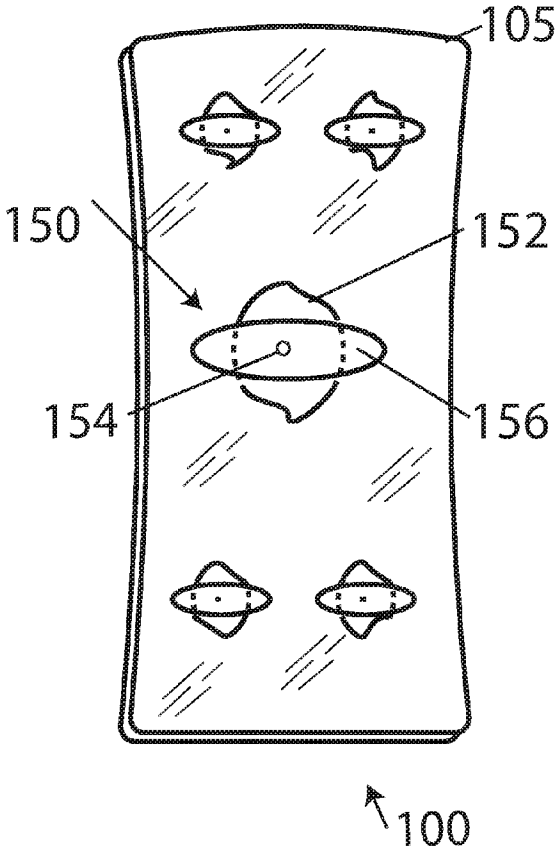
FIG. 4(*a*) illustrates a cross-sectional view of the mechanical individual module system in accordance with an exemplary embodiment of the invention.
Figure 4A:
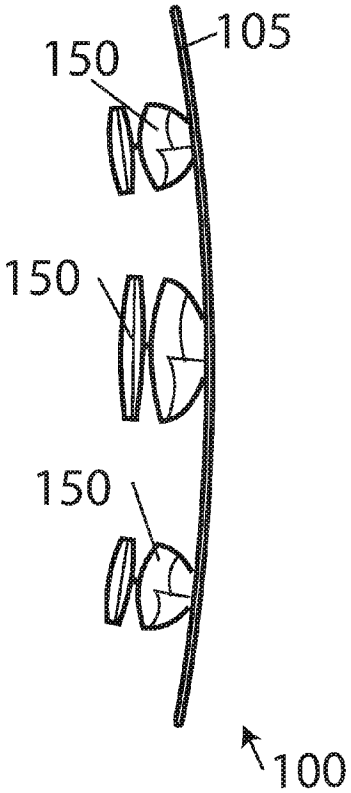
Figure 4C:
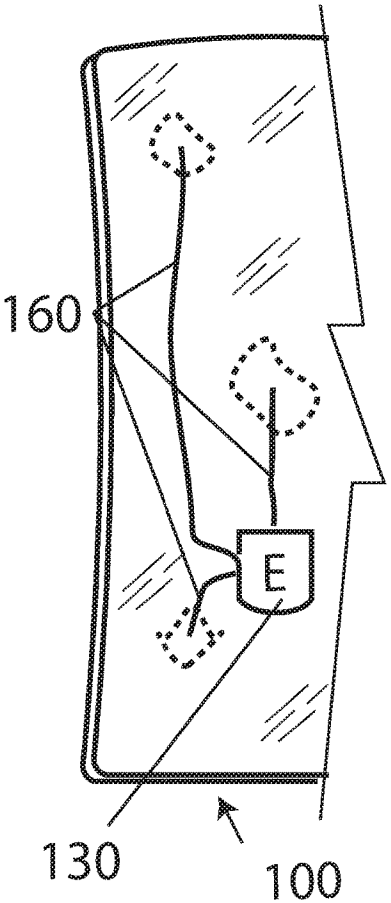

FIG. 4(*a*) illustrates a cross-sectional view of the mechanical individual module system in accordance with an exemplary embodiment of the invention. FIG. 4(*b*) illustrates a front view, and FIG. 4(*c*) illustrates a partial back view. The cushion (110) has an internal backboard (105) which support a plurality of individual pressure modules (150). Each individual pressure module (150) comprises a pressure sensing plate (156) with an actuator rod (154) which is extended or retracted by the actuator (152). The individual pressure modules (150) are wired (160) to a central controller (130) which senses the plurality of inputs and interfaces with a remote control or computing device to provide individual feedback to the user about current posture.

Figure 5:
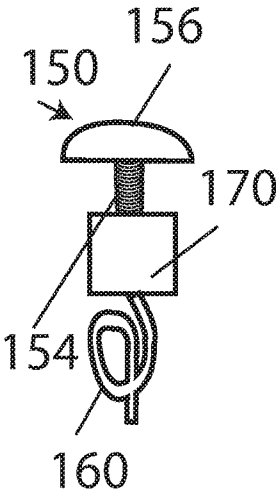
FIG. 5 illustrates an electrical individual pressure module system in accordance with an exemplary embodiment of the invention.

FIG. 5 illustrates an electrical individual pressure module system in accordance with an exemplary embodiment of the invention. The individual pressure module (150) has a pressure sensing plate (156) connected by an actuator rod (154), which in this case is a threaded rod, to an actuator (170) which extends or retracts the pressure plate (156) in accordance with a control signal sent via the controlling wires (160) from the controller (130, not shown).

The diagrams in accordance with exemplary embodiments of the present invention are provided as examples and should not be construed to limit other embodiments within the scope of the invention. For instance, heights, widths, and thicknesses may not be to scale and should not be construed to limit the invention to the particular proportions illustrated. Additionally, some elements illustrated in the singularity may actually be implemented in a plurality. Further, some elements illustrated in the plurality could actually vary in count. Some elements illustrated in one form could actually vary in detail. Specific numerical data values (such as specific quantities, numbers, categories, etc.) or other specific information should be interpreted as illustrative for discussing exemplary embodiments. Such specific information is not provided to limit the invention.

In the various embodiments in accordance with the present invention, embodiments are implemented as a method, system, and/or apparatus. As one example, the user interface may be implemented as one or more computer software programs to implement the methods described herein. The software is implemented as one or more modules (also referred to as code subroutines, or "objects" in object-oriented programming). The location of the software will differ for the various alternative embodiments. The software programming code, for example, is accessed by a processor or processors of the computer or server from long-term storage media of some type, such as a CD-ROM drive, cloud storage, or hard drive. The software programming code is embodied or stored on any of a variety of known media for use with a data processing system or in any memory device such as semiconductor, magnetic and optical devices, including a disk, hard drive, CD-ROM, ROM, etc. The code is distributed on such media, or is distributed to users from the memory or storage of one computer system over a network of some type to other computer systems for use by users of such other systems. Alternatively, the programming code is embodied in the memory (such as memory of the handheld portable electronic device) and accessed by the processor using the signal bus. The techniques and methods for embodying software programming code in memory, on physical media, and/or distributing software code via networks are well known and will not be further discussed herein.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A position and posture detection device comprising;
- a cushion positionable on a chair or seat between an occupant of the chair or seat and a seat back or seat bottom;
- wherein the cushion comprises:
  - a substantially rigid planar back support member;
  - a front covering substantially parallel to the back support member;
  - means for securing said cushion to said chair or seat;
  - one or more individual support modules between the back support member and the covering;
  - wherein each support module comprises:
    - a sensor module; and
    - a pressure module, including a cushion pad, a threaded rod supporting the cushion pad and received in a thread actuated by a motor attached to the back support member;
  - a processor, wherein the processor:
    - receives pressure data from the one or more sensor modules;
    - determines posture of the occupant utilizing the cushion;
    - determines an optimal posture for the; and
    - directs the controller to adjust the one or more support modules to urge a posture of the occupant toward the optimal posture.

2. The position and posture detection device as recited in claim 1, wherein:
- the cushion is a first cushion, the position and posture detection device further comprising a second cushion positionable to support a body through the buttocks of the occupant, the first and second cushion relative positions being determinable to further identify a posture of the occupant.

3. A posture correcting cushion comprising:
- a back cushion positionable on a chair or seat between an occupant and a seat back;
- wherein the back cushion comprises:
  - an elongate substantially rigid planar back support member;
  - at least one of a front covering and a foam support;
  - means for securing said cushion to said chair or seat;
  - one or more individual support modules between the back support member and the covering or the foam support;
  - wherein each support module comprises:
    - a sensor module; and
    - a pressure module, including a cushion pad, a threaded rod supporting the cushion pad and received in a thread actuated by a motor attached to the back support member;
  - a processor, wherein the processor:
    - receives pressure data from the one or more sensor modules;
    - determines posture of the occupant utilizing the cushion;
    - determines an optimal posture for the occupant; and
    - directs the controller to adjust the one or more support modules to urge a posture of the occupant toward the optimal posture.

4. The posture correcting cushion recited in claim 3, further comprising:
- a bottom cushion positionable on a seat bottom of the chair or seat between the occupant and the seat bottom of the chair or seat; wherein the bottom cushion comprises:
  - an elongate substantially rigid planar back support member of the bottom cushion;
  - a front covering of the bottom cushion;
  - means for securing said bottom cushion to said seat bottom; and one or more individual support modules between the back support member and the covering of the bottom cushion, wherein each support module is configured to communicate with the processor to further determine the posture of the occupant utilizing the bottom cushion;

wherein the bottom cushion receives direction from the controller to adjust the one or more support modules, urging the posture of the occupant toward the optimal posture.

5. The posture correcting cushion recited in claim 4 wherein said bottom cushion is attached to a lower end of said back cushion.

6. The posture correcting cushion recited in claim 3, wherein the processor executes a software program for:

determining a current posture of the occupant;

determining the optimal posture;

measuring and displaying the current and optimal postures through a visual output of a back and sitting region of the occupant;

logging posture information for each of a plurality of occupants, including said occupant;

providing immediate feedback and control to the occupant; and providing long-term storage of posture information for each of the plurality of occupants.

7. The posture correcting cushion recited in claim 6, wherein the software program measures and corrects the posture of the occupant by adjusting the back and sitting regions of the occupant.

8. The posture correcting cushion recited in claim 6, wherein the processor sends posture data of the occupant to a personal computer to activate a user interface, and the personal computer is configured to display the data received from the processor.

9. The posture correcting cushion recited in claim 8, wherein the processor sends the posture data of the occupant to a personal wireless device to activate the user interface, and the personal wireless device is configured to display the data received from the processor.

* * * * *